US007614122B2

(12) United States Patent
Pferdmenges et al.

(10) Patent No.: US 7,614,122 B2
(45) Date of Patent: Nov. 10, 2009

(54) APPARATUS ON A SPINNING PREPARATION MACHINE, ESPECIALLY A FLAT CARD, ROLLER CARD, CLEANER OR THE LIKE, WITH A COOLING SYSTEM

(75) Inventors: Gerd Pferdmenges, Jüchen (DE); Markus Schmitz, Mönchengladbach (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 582 days.

(21) Appl. No.: 11/415,187

(22) Filed: May 2, 2006

(65) Prior Publication Data

US 2007/0006423 A1 Jan. 11, 2007

(30) Foreign Application Priority Data

Jun. 24, 2005 (DE) ..... 10 2005 029 767

(51) Int. Cl.
*D01G 15/16* (2006.01)

(52) U.S. Cl. ..... 19/112

(58) Field of Classification Search ..... 19/98, 19/112

See application file for complete search history.

(56) References Cited

U.S. PATENT DOCUMENTS

| | | | | |
|---|---|---|---|---|
| 1,837,562 | A * | 12/1931 | Mayer | 165/89 |
| 2,339,557 | A * | 1/1944 | Runals | 34/115 |
| 4,074,750 | A | 2/1978 | Beghin | |
| 4,443,689 | A * | 4/1984 | Muller et al. | 219/469 |
| 5,208,955 | A * | 5/1993 | Schiel | 492/12 |
| 5,277,690 | A | 1/1994 | Schiel | |
| 5,920,961 | A | 7/1999 | Hollingsworth | |
| 6,209,451 | B1 | 4/2001 | Van Haag et al. | |
| 2003/0110594 | A1 * | 6/2003 | Pferdmenges et al. | 19/98 |

FOREIGN PATENT DOCUMENTS

| | | |
|---|---|---|
| DE | 40 37 339 A1 | 6/1991 |
| EP | 0 077 166 A1 | 4/1983 |
| EP | 0 431 485 B1 | 8/1997 |

(Continued)

OTHER PUBLICATIONS

The British Search Report for Application No. GB0612233.7, Oct. 19, 2006.

(Continued)

*Primary Examiner*—Shaun R Hurley
(74) *Attorney, Agent, or Firm*—Venable LLP; Robert Kinberg; Justine A. Gozzi

(57) ABSTRACT

An apparatus on a spinning preparation machine, especially a flat card, roller card, cleaner or the like, with a cooling system, a roller has a cylindrical peripheral surface and a casing opposite to and spaced from this peripheral surface, a carding region where carding work is carried out and heat is generated being present between the peripheral surface of the roller and a part of the casing. A cooling medium enters the interior void space of the roller, passes through and exits again. In order to reduce or avoid thermal expansion of the roller in a structurally simple manner, the cooling medium is a cooling gas, especially air, which is capable of absorbing heat in the interior void space of the roller and dissipating it from the interior void space of the roller.

22 Claims, 5 Drawing Sheets

FOREIGN PATENT DOCUMENTS

| | | | |
|---|---|---|---|
| EP | 0 962 591 | A2 | 12/1999 |
| EP | 1 031 650 | A2 | 8/2000 |
| FR | 2305257 | A | 10/1976 |
| GB | 03173 | | 12/1913 |
| GB | 191303173 | A | 12/1913 |
| GB | 1421384 | | 1/1976 |
| GB | 1539990 | | 2/1979 |
| GB | 2250234 | A | 3/1992 |
| WO | WO 93/06273 | | 4/1993 |
| WO | WO 9306273 | A1 | 4/1993 |

OTHER PUBLICATIONS

French Search Report dated Aug. 28, 2007, issued in Application No. FR 0652623.
Written Opinion, issued in Application No. FR 06 52623.

* cited by examiner

APPARATUS ON A SPINNING PREPARATION MACHINE, ESPECIALLY A FLAT CARD, ROLLER CARD, CLEANER OR THE LIKE, WITH A COOLING SYSTEM

CROSS REFERENCE TO RELATED APPLICATION

This application claims priority from German Patent Application No. 10 2005 029 767.6 dated Jun. 24, 2005, the entire disclosure of which is incorporated herein by reference.

BACKGROUND OF THE INVENTION

The invention relates to an apparatus on a spinning preparation machine, especially a flat card, roller card, cleaner or the like, with a cooling system, in which a roller has a cylindrical peripheral surface and a casing opposite to and spaced from this peripheral surface, a carding region where carding work is carried out and heat is generated being present between the peripheral surface of the roller and a part of the casing.

The spacings between the cylinder clothing and surfaces (counter-surfaces) located opposite it are of considerable importance in terms of machine engineering and fibre technology. The carding result, namely, cleaning, nep reduction and fibre shortening, is substantially dependent on the carding gap, that is, the spacing between the cylinder clothing and the clothings of the revolving and fixed flats. Routing of the airflow around the cylinder and heat dissipation are likewise dependent on the spacing between the cylinder clothing and opposing clothed or non-clothed surfaces, for example, separator blades or casing elements. The spacings are subject to various, in some cases oppositely directed, influences. The abrasion of opposing clothings leads to enlargement of the carding gap, which is associated with an increase in the number of neps and a decrease in fibre shortening. The consequence of an increase in cylinder speed, e.g. to enhance the cleaning action, is an expansion of the cylinder including the clothing owing to the centrifugal force, and hence a reduction in the carding gap. When processing large quantities of fibre and specific types of fibre, for example, synthetic fibres, the cylinder also expands, due to an increase of temperature, more than the rest of the machine around it, so that for this reason as well the spacings decrease. The machine elements, for example, fixed carding segments and/or separator blades, located radially opposite the cylinder also expand.

The carding gap is influenced in particular by the machine settings on the one hand and the state of the clothing on the other hand. The most important carding gap of the revolving flat card is located in the main carding zone, that is, between the cylinder and the revolving flat assembly. At least one clothing, which defines the operating distance of the carding zone as a whole, is in motion. In order to increase the production of the carding machine, one tries to select the operating speed of rotation or operating speed of the moving elements to be as high as the technology of fibre processing allows. The operating distance is located in the radial direction (starting from the axis of rotation) of the cylinder.

In the case of carding, increasingly larger amounts of fibre material per unit of time are being processed, which means higher speeds of the working elements and higher installed powers. With the working surface remaining constant, increasing throughput of fibre material (production) leads to greater generation of heat owing to the mechanical work. At the same time, however, the technological carding result (sliver uniformity, degree of cleaning, reduction of neps etc.) is continuously improved, which means more active surfaces engaged in carding, and settings of these active surfaces closer to the cylinder (drum). The proportion of synthetic fibres to be processed, with which, compared to cotton, more heat is generated through frictional contact with the active surfaces of the machine, is continually increasing. The working elements of high-performance carding machines are today fully enclosed all round in order to comply with safety standards, prevent particle emission into the spinning works environment and minimise the need for maintenance of the machines. Grids or even open, material-guiding surfaces that allow exchange of air belong to the past. The situations described appreciably increase the input of heat into the machine, whereas discharge of heat by means of convection drops appreciably. The resulting more marked heating of high-performance carding machines leads to greater thermoelastic deformation, which has an influence on the set spacings of the active surfaces owing to the uneven distribution of the temperature field: the spacings between cylinder and card top, doffer, fixed card tops and separation points equipped with blades decrease. In an extreme case the set gap between the active surfaces can close up completely, so that components moved relative to one another collide. The high-performance carding machine affected suffers considerable damage. Moreover, the generation of heat in the working region of the card can lead to different thermal expansion when the temperature difference between components is too great.

In the case of a known apparatus (EP-A-0 077 166), a liquid transport system is provided within the cylinder to balance the temperature conditions at the periphery of the cylinder. Two through-bored shaft journals are provided, through which a respective hose containing the liquid is routed. The hoses are connected to channels that are arranged along the inner peripheral surface of the cylinder. The cooling liquid enters and leaves on different sides of the cylinder. The known apparatus is extremely complex as regards its arrangement, both in relation to construction and assembly and also in relation to operation. The cooling liquid is admitted under pressure to the interior of the cylinder using an external pump. The rotary connection between the pump system and the roller cooling system requires especially careful construction and sealing to provide a reliable seal against leakage of the cooling liquid. The use of liquid in a spinning preparation machine is problematical and is avoided in practice. Complete canalisation of the cooling liquid is required, which leads to zoned cooling of the roller and hence to undesirable local deformation of the roller. Furthermore, it is problematic that the mass moment of inertia of the roller is undesirably changed, i.e. clearly increased, owing to the considerable amount of cooling liquid. This calls for a greater input power for the roller. In addition, the temperature of the liquid and/or of the roller is to be monitored, which requires further substantial outlay on apparatus. It is nevertheless impossible to achieve uniform temperature conditions and hence a constant carding gap.

It is an aim of the invention to produce an apparatus of the kind described in the introduction, which avoids or mitigates the said disadvantages, which in particular reduces or avoids thermal expansion of the roller in a structurally simple manner and allows a constant carding gap to be maintained.

SUMMARY OF THE INVENTION

The invention provides an apparatus on a spinning preparation machine comprising a roller having an interior void space;

roller casing; and a carding region where carding work is carried out, wherein the roller has at least one inlet for a cooling gas to enter the interior void space for cooling the roller and at least one outlet for the cooling gas to exit from the interior void space.

Because cooling gas, preferably air, that absorbs and dissipates heat is, for example, suctioned through the interior void space, the radial thermal expansion of the roller within the warming-up phase and also during routine operation is reduced or avoided. Because the heat being transferred to the air by convection (contact between air and inner peripheral roller wall and inner walls of the roller end discs) and by radiation (thermal radiation into the air from the inner peripheral roller wall and from the roller end discs) is removed from the roller interior, a greater degree of efficiency is achieved. In this way a constant carding gap can be achieved during operation. A particular advantage is that the cooling effect is achieved with components of the machine and no additional cooling system is used. The interior void space of the roller is used as "flow channel", resulting in an especially uniform distribution and cooling effect.

An especially simple construction of the cooling system is achieved by guiding the air in and out through the inner hollow space of the shaft journals of the roller.

Advantageously, at least one hollow cylindrical shaft journal is present at both ends of the roller. The cooling medium may then be admitted through a shaft journal and/or may be discharged through a shaft journal. Preferably, the cooling medium is admitted and discharged through different shaft journals.

Advantageously, the cooling medium is admitted and discharged on different sides of the machine. The cooling medium may be admitted through at least one end face of the roller. Advantageously, suction passes through the interior void space of the roller. Advantageously, the interior void space of the roller and an interior space in at least one shaft journal, preferably both shaft journals, is traversed by air.

In one embodiment, compressed air passes through the inner space of the roller. Advantageously, the interior void space of the roller and the interior space in at least one shaft journal, preferably the interior spaces in both the shaft journals, is/are traversed by compressed air. The air advantageously dissipates convection heat and/or radiant heat. Advantageously, the air flows at least partially along the inner peripheral surface of the roller. Advantageously, the air flows at least partly along the inner surfaces of the roller end discs (end walls). Advantageously, the shaft journal for air discharge is connected to the machine extraction system. Advantageously, the shaft journal for air discharge is connected to the intake side of a fan. Advantageously, the fan is fixed in position.

In one advantageous embodiment, a shaft journal for air intake draws in ambient air through an intake opening. A conically tapering air guide element, for example, a funnel or the like, may be associated with the intake opening. The conically tapering air guide element is advantageously rotatable about its longitudinal axis.

In another advantageous embodiment, a shaft journal for air intake is connected to a source of compressed air. A shaft journal for air discharge may open into the external air. Advantageously, at least one air guide element is present in the interior void space of the roller. Advantageously, at least one air distributor element is present in the interior void of the roller. Advantageously, ribs, blades or the like are present in the interior void space of the roller. Advantageously, the air flows in on the drive side of the roller. Advantageously, the air flows out on the non-driven side of the roller. Advantageously, the drive wheel has a funnel-form air inlet opening. Advantageously, a shaft journal for admission of air is conically tapered on it intake side. Advantageously the shaft journal for discharge of air is conically tapered on its intake side. Advantageously, the air passes through at least one bearing, preferably through the bearings of the shaft journals. Advantageously, one end of an extraction line (extraction duct) is attached to a fixed bearing. Advantageously, the outlet of a shaft journal for air discharge opens into the inlet of the fixed extraction duct. Advantageously, the at least one shaft journal, preferably each shaft journal, has a continuous bore in the axial direction. Advantageously, some of the air in the machine extraction system is used for through suction.

The roller may be the cylinder of a flat card, the cylinder of a roller card, at least one licker-in, or the doffer of a card. Advantageously, the incoming air is pre-cooled. Advantageously, the shaft journal for air discharge is connected to a dust-extraction device. Advantageously, the air in the region of the roller inner wall flows substantially axially. Advantageously, the air in the interior void space of the roller flows substantially helically. Advantageously, the air in the interior void space of the roller flows at least partially laminarly. Advantageously, the air in the interior void space of the roller flows at least partially turbulently. Advantageously, the airflow in the heating-up phase is adaptable to the increasing temperature of the roller. Advantageously, the airflow in the operating phase is largely constant. Advantageously, the airflow is adaptable to modified operating conditions, for example, change of goods, change of the working elements of the roller or the like. Advantageously, the temperature in the interior void space of the roller is measurable. Advantageously, the temperature of the casing of the roller is measurable. Advantageously, the temperature of the incoming air is adaptable to the temperature of the interior void space of the roller and/or to the temperature of the casing of the roller. Advantageously, the temperature of a cooling device for the air is adjustable.

The invention also provides an apparatus on a spinning preparation machine, especially a flat carding machine, roller carding machine, cleaner or the like, with a cooling system, in which a roller has a cylindrical peripheral surface and a casing opposite to and spaced from this peripheral surface, a carding region where carding work is carried out and heat is generated being present between the peripheral surface of the roller and a part of the casing, and in which, in relation to the inner space of the roller, a cooling medium enters, passes through and exits again, characterised in that the cooling medium is air, which is capable of absorbing heat in the interior void space of the roller and dissipating it from the interior void space of the roller.

DESCRIPTION OF CERTAIN PREFERRED EMBODIMENTS

Figure 1:
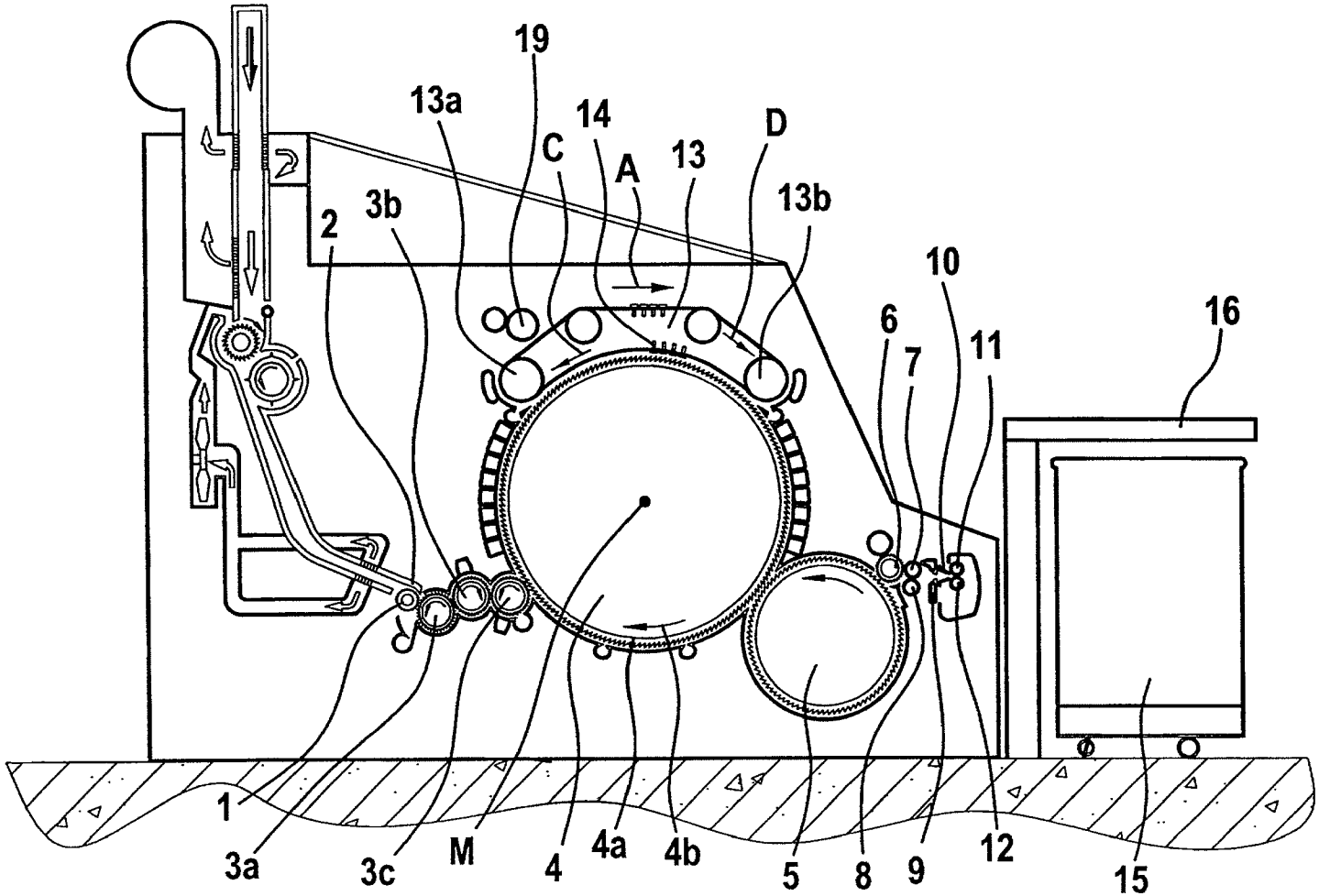
FIG. 1 is a schematic side view of a carding machine with a roller (cylinder) cooled according to the invention.

FIG. 1 shows a card, for example, a card TC 03 (trade mark) made by Trützschler GmbH & Co. KG of Mönchengladbach, Germany, with feed roller 1, feed table 2, licker-ins 3*a*, 3*b*, 3*c*, cylinder 4, doffer 5, stripping roller 6, squeezing rollers 7, 8, web-guide element 9, web funnel 10, take-off rollers 11, 12, revolving flat 13 with flat guide rolls 13*a*, 13*b* and flat bars 14, can 15 and can coiler 16. The directions of rotation of the rollers are shown by respective curved arrows. The letter M denotes the midpoint (axis) of the cylinder 4 and A denotes the working direction. The reference numeral 4*a* denotes the clothing and 4*b* denotes the direction of rotation of the high-speed cylinder 4. The letter C denotes the direction of rotation of the revolving flat 13 in the carding position and D denotes the reverse transport direction of the flat bars 14.

Figure 2:
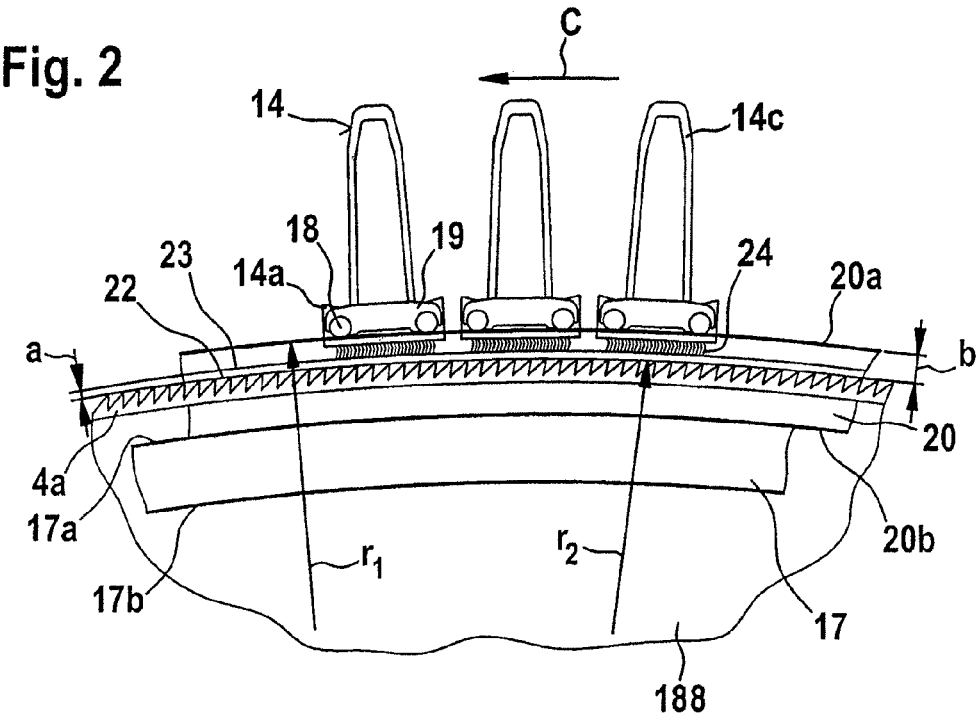
FIG. 2 shows a carding gap between the clothings of revolving card flats and the cylinder clothing.

Referring to FIG. 2, a flexible bend 17 having several adjusting screws is secured by screws laterally on each side to the machine frame. The flexible bend 17 has a convex outer surface 17*a* and a lower surface 17*b*. Above the flexible bend 17, there is a slideway 20, for example, of anti-friction plastics material, which had a convex outer surface 20*a* and a concave inner surface 20*b*. The concave inner surface 20*b* lies on the convex outer surface 17*a*. The card flat bars 14, which comprise extruded aluminium, have at both ends a respective card flat heel part 14*a*, (14*b* is not shown) secured to which in the axial direction are two steel pins 18 that slide on the convex outer surface 20*a* of the slideway 20 in the direction of arrow C. The card flat clothing 24 is mounted on the lower surface of the card flat heel part 14*a*. The reference number 23 denotes the tip circle of the card flat clothings 24.

On its circumference, the cylinder 4 has a cylinder clothing 4*a*, for example, saw-tooth clothing. The reference numeral 22 denotes the tip circle of the cylinder clothing 4*a*. The distance (carding gap) between the tip circle 23 and the tip circle 22 is denoted by the letter a, and is, for example, 2/1000". The carding gap is in practice accurately set by means of a gauge in the cold state of the carding machine, that is, the cylinder 4 with the cylinder clothing 4*a* and the card flat bars 14 with the card flat clothings 24, and remains constant during operation, even when the machine has warmed up, owing to the cooling device according to the invention. The distance between the convex outer surface 20*a* and the tip circle 22 is denoted by the letter b. The radius of the convex outer surface 20*a* is denoted by $r_1$ and the constant radius of the tip circle 22 is denoted by $r_2$. The radius $r_2$ intersects the mid-point M (see FIG. 1) of the cylinder 4. The reference numeral 14*c* denotes the back of the card flat. The reference numeral 19 denotes a clamping element, which engages around the card flat pins 18 and is connected to the drive belt (not shown) for the card flat bars 14.

Figure 3:
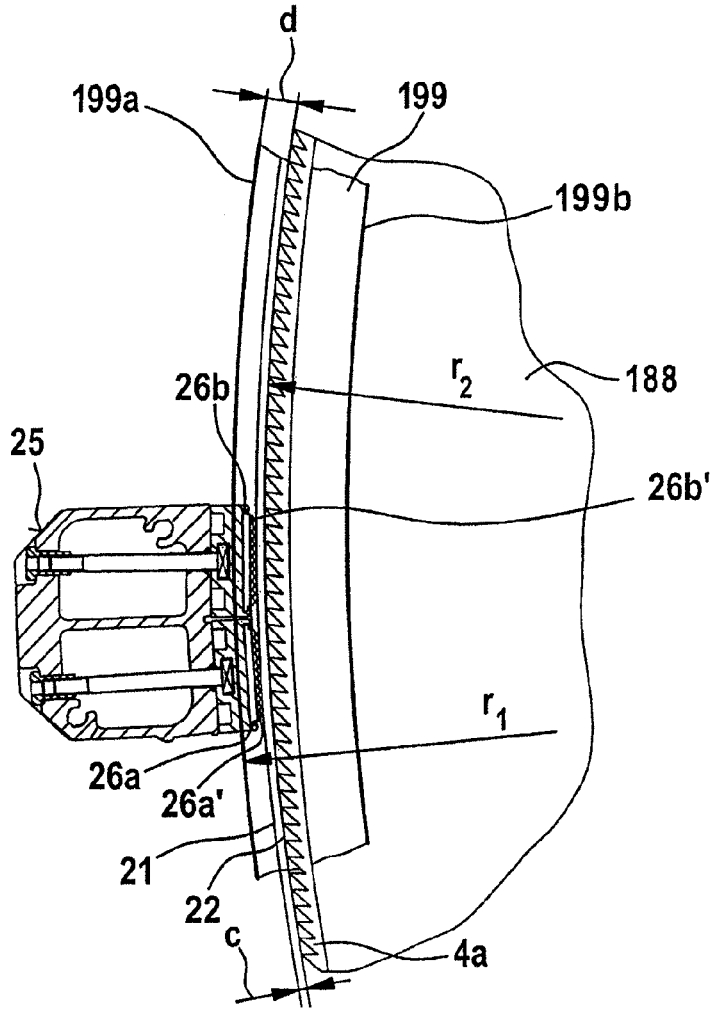
FIG. 3 shows a carding gap between the clothing of a fixed carding element and the cylinder clothing.

Referring to FIG. 3, on each side of the carding machine an approximately semi-circular rigid side plate 188 is secured laterally to the machine frame (not shown); cast concentrically onto its outer side in the region of the periphery is a curved, rigid bearing element 199, which has a convex bearing surface 199*a* as its support surface and an under side 199*b*. Fixed carding elements 25 have bearing surfaces at both ends that lie on the convex outer surface 199*a* of the bearing element. Carding elements 26*a*, 26*b* with carding clothings 26*a*', 26*b*' are mounted on the lower surface of the carding segment 25. The reference number 21 denotes the tip circle of the carding clothings 26*a*', 26*b*. The cylinder 4 has on its periphery a cylinder clothing 4*a*, for example a saw tooth clothing. The reference numeral 22 denotes the tip circle of the cylinder clothing 4*a*. The distance between the tip circle 21 and the tip circle 22 is denoted by the letter c, and is, for example, 0.20 mm. The distance between the convex outer surface 199*a* and the tip circle 22 is denoted by the letter d. The radius of the convex outer surface 199*a* is denoted by $r_1$ and the radius of the tip circle 22 is denoted by $r_2$. The radii $r_1$ and $r_2$ intersect at the mid-point M (see FIG. 1) of the cylinder 4. The carding segment 25 shown in FIG. 3 consists of a support 23*a* and two carding elements 26*a*, 26*b*, which are arranged in succession in the direction of rotation (arrow 4*b*) of the cylinder 4, the clothings of the carding elements 26*a*, 26*b* and the clothing 4*a* of the cylinder 4 lying opposite each other. The distance c between the clothings 26*a*', 26*b*' of the carding elements 26*a*, 26*b* and the cylinder clothing 4*a* can be set exactly when the machine is in its cold state, for example, using a gauge, and remains constant during operation, even when the machine has warmed up, owing to the cooling device according to the invention.

Figure 4:
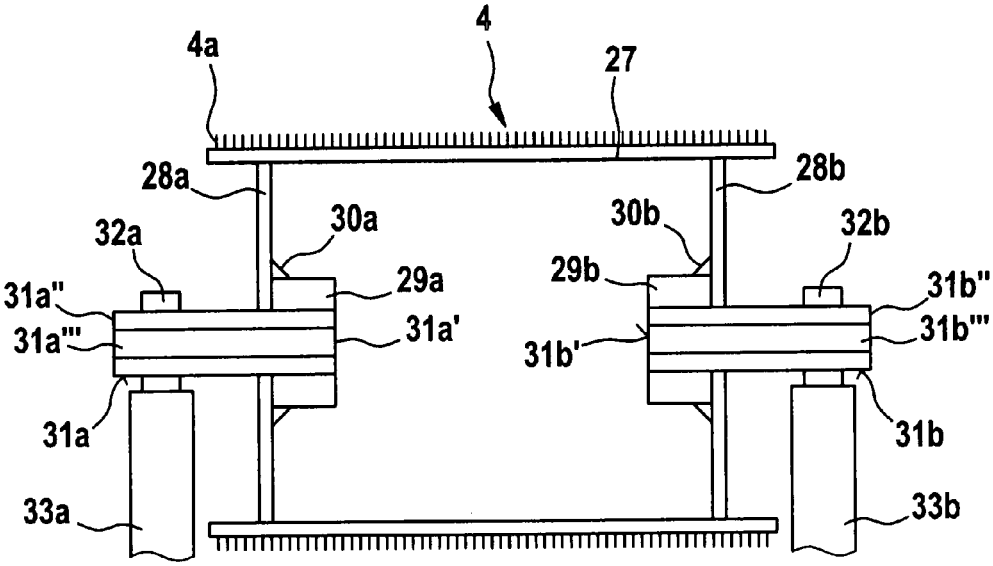
FIG. 4 shows a cross-section through the cylinder according to FIG. 1 with two short, through-bored shaft journals.

The cylinder 4 illustrated in FIG. 4 has a casing 27 of sheet steel. At its two ends, the casing 27 is supported by a respective cylinder end disc 28*a*, 28*b* on a substantially hollow cylindrical hub 29*a* and 29*b* respectively (bushing). The hubs 29*a*, 29*b* are attached to the cylinder end discs by means of welded joints 30*a*, 30*b*. The hub 29*a* is non-rotatably secured to a short cylindrical shaft journal 31*a*by an adhesive bond. The inner end faces 31*a*', 31*b*' of the shaft journals are substantially flush with the inner end faces of the hubs. The outer end faces 31*a*", 31*b*" project beyond the lateral surfaces of the cylinder 4 outwards. The outer ends of the shaft journals 31*a* and 31*b* are mounted in fixed bearings 32*a* and 32*b* respectively. The fixed bearings 32*a* and 32*b* rest supports 33*a* and 33*b* respectively. The cylinder 4 has a circumferential speed of, for example, 40 m/sec. The shaft journals 31*a* and 31*b* are of hollow cylindrical construction and have continuous bores 31*a*'" and 31*b*'" respectively.

Figure 5:
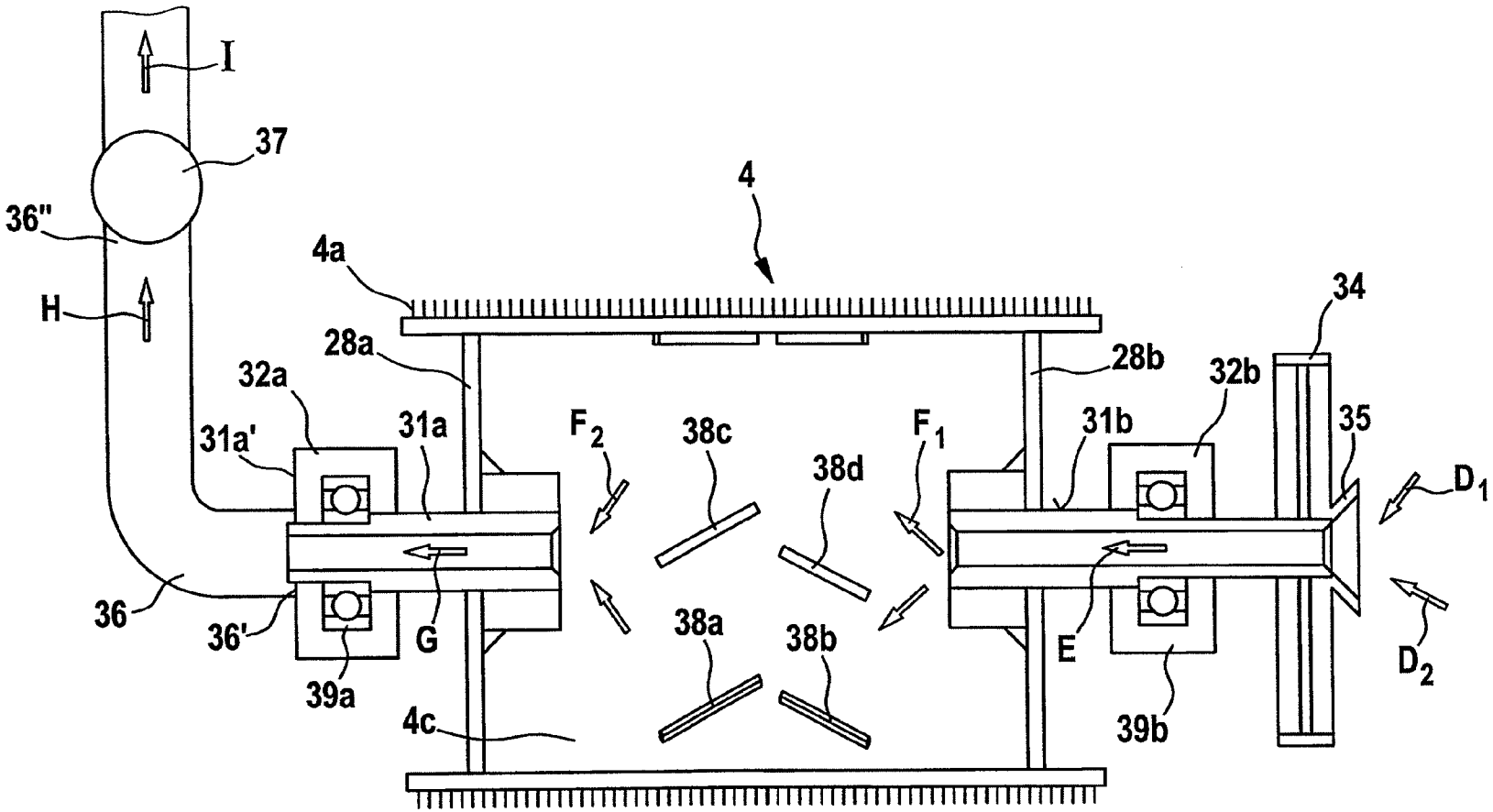
FIG. 5 shows the cylinder according to FIG. 1 with air intake device, air passage through the interior of the cylinder and air extraction device.

Referring to FIG. 5, in a cooling system suction is applied to the interior void space 4*c* of the cylinder 4, whereby heat or warm air is discharged from the interior void space. The drive wheel 34 is non-rotatably secured to the outer region of the shaft journal 31*b*. A conically tapering suction head 35 is associated with the drive wheel 34 on its side remote from the cylinder end disc 28*b*. The continuous bore 31*b*'" of the shaft journal 31*b* for the admission of air $D_1$, $D_2$ from the atmosphere is conically tapered on its intake side 31*b*" (see FIG. 4). The suction head 35 and the shaft journal 31*b* are arranged coaxially with respect to one another, the outlet of the suction head 35 being associated with the outer end face 31*b*". The inner end face 31*b*" of the shaft journal terminates in the interior void space 4*c*. The continuous bore 31*a*'" of the shaft journal 31*a* for the removal of air $F_2$ from the interior void space 4*c* of the cylinder 4 is conically tapered at its end 31*a*'. One end 36' of an extraction duct 36 is secured in an airtight manner to the side 32*a*' of the fixed bearing 32*a* remote from the cylinder end disc 28*a*, and its other end 36" is connected to the suction side of a fan 37. The fan 37 is part of the machine extraction system, with which inter alia dust-laden air is extracted from the machine. Air guides 38*a* to 38*d* serving to distribute the air flows $F_1$ and $F_2$ are present in the interior void space 4*c* of the cylinder 4. 39*a*, 39*b* denote ball bearings.

During operation, air flows $D_1$, $D_2$ (the temperature of which is lower than the temperature of the air in the inner space 4*a*) enter from the atmosphere, channelled via the head 35, through the end face 31*b*" into the conical bore 31*b*'", pass through the bore 31*b*'" as an air flow E and emerge at the end face 31*b*' from the bore 31*b*'" into the interior void space 4*c* in the form of air flows $F_1$. The guides 38*a* to 38*d* distribute the air flows $F_1$ in the interior void space 4*c*, during which the air flows $F_1$ absorb heat that is released to the air $F_1$ from the inner peripheral surface of the casing 27 and the inner peripheral surfaces of the cylinder end discs 28*a* and 28*b*, wherein a heat exchange takes place. The air $F_1$ is heated and cools the casing 27 and the cylinder end discs 28*a* and 28*b*. Then, by virtue of the induced draught of the fan 37, the heated airflow $F_2$ enters the tapered bore 31*a*" through the end face 31*a*' and emerges from the bore 31*a*'" at the end face 31*a*$^I$ into the extraction duct 36. The fan 37 extracts the airflow H from the extraction duct 35, and this airflow leaves the pressure side of the fan 37 as the airflow I.

Air is entrained in the manner according to the invention through a roller 4 via the particular bearing point, which leads to cooling of the roller 4 by convention. This means that the roller construction has journals 31*a*, 31*b* and these journals 31*a*, 31*b* have a respective continuous bore 31*a*'", 31*b*'" and are subjected to suction. Preferably, some of the air in the machine extraction system (cf. fan 37) is used for the extraction. At the same time an airflow is induced, one arm 36' of an extraction duct 36 being connected to the opening of one of the two bearing journals. A current of air from the opposite side (intake side) to the extraction side is thereby established. Preferably, the drive side is the intake side and the non-driven side is the extraction side. The drive wheel 34 is shaped so that an intake head 35 for the inflowing ambient air $D^1$, $D_2$ is formed there. In its interior void space 4*c* the cylinder 4 or roller contains guide elements 38*a* to 38*d* (e.g. ribs, blades, reinforcing ribs), which provide for proper air distribution in the roller 4. A computed heat dissipation develops as follows:

$$\Delta\dot{Q}=\dot{m}\cdot c\cdot\Delta T$$

Figure 6:
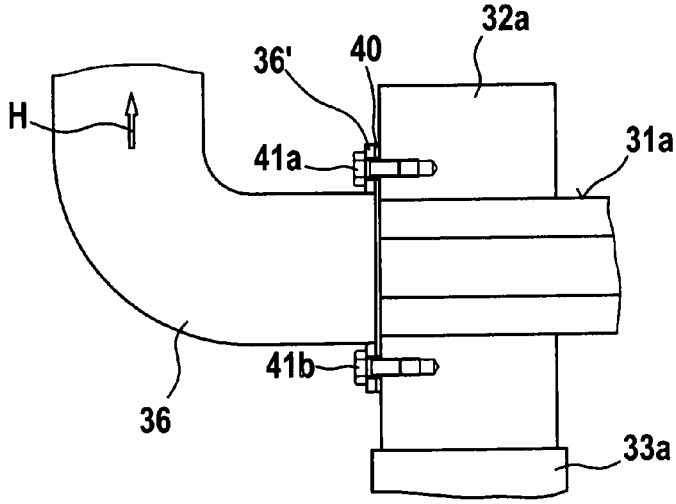
FIG. 6 shows the hermetically sealed connection of the extraction duct to the bearing of the shaft journal for air discharge.

$\Delta\dot{Q}$=exchanged heat flow $\dot{m}$=mass flow c=specific heat capacity $\Delta T$=temperature difference Referring to FIG. 6, a sealing ring 40 (circular ring) is arranged between the flange-form end region 36' of the extraction duct 36 and the outside 32*a*' of the bearing 32*a*. The end region 36*a*' is secured to the bearing 32*a* by fixing means, e.g. screws 41*a*, 41*b*.

Figure 7:
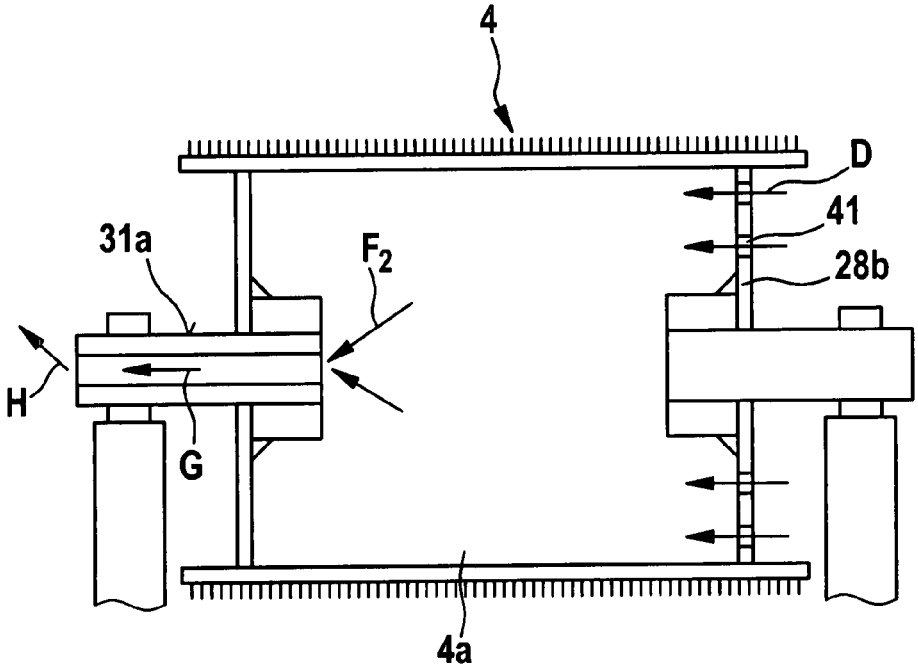
FIG. 7 shows an embodiment similar to FIG. 4, but only one through-bored shaft journal for air discharge is present and the air is drawn in from the surroundings through openings in a cylinder end disc.

According to FIG. 7, the cylinder end disc 28*b* has a plurality of continuous air inlet openings 41, through which airflows D enter from the external area into the interior void space 4*a* of the cylinder 4. In the example shown in FIG. 7, the shaft journal 31*b* does not have a bore. It may be expedient, however, for the shaft journal 31*b* to be provided additionally with a bore 31*b*'" (not shown in FIG. 7), the result being that the amount of inflowing air is increased. The airflow $F_2$ can be extracted through the bore 31*a*'" in the shaft journal 31*a* as the airflow G (see FIG. 5).

Figure 8:
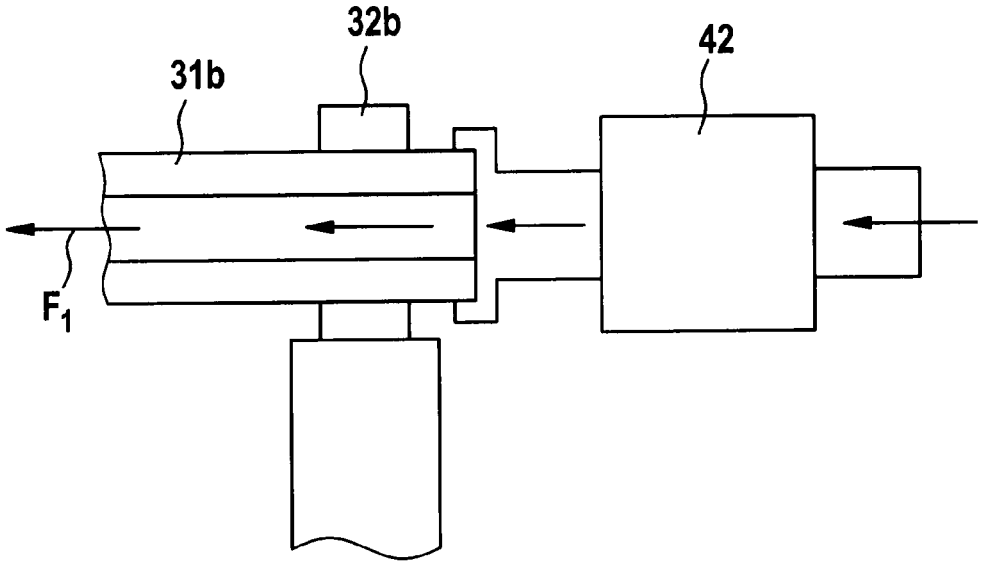
FIG. 8 shows an embodiment with a cooling apparatus for pre-cooling the entering air.

According to FIG. 8, an air-cooling arrangement 42 is provided, producing a pre-cooled airflow D that passes through the bore 31*b*" of the shaft journal 31*b* as the airflow $F_1$ into the interior void space 4*a* of the roller 4. In this way, the heat content or temperature of the airflow D to be introduced can be adapted or matched to the heat content or temperature of the air in the interior void space 4*a* of the roller, such that heating of the roller 4 attributable to carding work is fully compensated, so that radial thermal expansion of the roller 4 is avoided and the set and desired carding gap remains continuously constant.

In the construction according to FIG. 8, it can be expedient to measure the temperature in the interior void space 4*c* and/or at the casing 27 of the cylinder 4, and, using the cooling system 42, to lower the temperature of the incoming air $D_1$, $D_2$ to below the temperature of the air in the interior void space 4*c*, so that despite warming attributable to carding work the temperature in the interior void space 4*c* or of the casing 27 of the roller 4 with the machine in the cold state remains constant. In this way, a narrow carding gap can be set on the cold machine and be maintained when the machine heats up, which is desirable technically. Furthermore, it can be advantageous for the temperature of the cooling system 42 to be adjustable. The adjustment can be effected, for example, manually according to preset values, or as a function of the temperature in the interior void space 4*c* or of the casing 27 of the roller 4.

It will be understood that reference herein to the use of air as the cooling gas includes reference to any cooling gas consisting substantially of air.

Although the foregoing invention has been described in detail by way of illustration and example for purposes of understanding, it will be obvious that changes and modifications may be practised within the scope of the appended claims.

What is claimed is:

1. An apparatus on a spinning preparation machine comprising:

a hollow roller, the roller including a first end face and a second end face opposed to the first end face to enclose the roller, wherein the first end face, the second end face, and an inner surface of the roller define an interior void space;

a roller casing;

a first hollow journal shaft supporting the first end face, wherein the first hollow journal shaft acts as a gas inlet for a cooling gas to enter the interior void space for cooling the roller;

a second hollow journal shaft supporting the second end face, wherein the second hollow journal shaft acts as a gas outlet for the cooling gas to exit from the interior void space; and a carding region where carding work is carried out, and wherein the first hollow journal shaft and the second hollow journal shaft are discontinuous.

2. An apparatus according to claim 1, in which the cooling gas is air.

3. An apparatus according to claim 1, further comprising a device for supplying compressed air as cooling gas.

4. An apparatus according to claim 1, in which the cooling gas is cooled in a cooling device before it enters the gas inlet.

5. An apparatus according to claim 1, in which the roller comprises one or more internal structures for channelling and/or dispersing the cooling gas.

6. An apparatus according to claim 5, in which the structures comprise blades or ribs.

7. An apparatus according to claim 1, in which the cooling gas is arranged to pass along the inner surface of the roller wall.

8. An apparatus according to claim 1, in which the gas is arranged to travel along a helical pathway along the inner surface of the roller.

9. An apparatus according to claim 1, in which the cooling gas can dissipate heat received from the roller convectively or radiatively from the roller.

10. An apparatus according to claim 1, in which the gas outlet is connected to a machine extraction system.

11. An apparatus according to claim 1, comprising a suction device for drawing cooling gas through the roller.

12. An apparatus according to claim 1, further comprising a rotatable, conically tapering guide element for intake of cooling gas.

13. An apparatus according to claim 1, in which the outlet is arranged to deliver the cooling gas into ambient air.

14. An apparatus according to claim 1, in which the gas inlet is on the same side as a drive device for the machine and the outlet is on the opposed side of the machine.

15. An apparatus according to claim 1, in which the inlet and/or the outlet comprises a conically tapered intake portion.

16. An apparatus according to claim 1, in which the outlet is a hollow journal of the roller and an extraction line for the gas is attached to a bearing of said journal.

17. An apparatus according to claim 1, in which there is used as cooling gas a proportion of air that is used for an extraction system for one or more working elements of the machine.

18. An apparatus according to claim 1, in which the roller is a carding cylinder.

19. An apparatus according to claim 1, in which the roller is a licker-in or a doffer of a card.

20. An apparatus according to claim 1, in which the flow of cooling gas is adaptable, in a heating-up phase on commencement of processing, to the increasing temperature of the roller.

21. An apparatus according to claim 1, in which the flow of cooling gas in an operating phase of the machine is adjustable in dependence upon operating conditions.

22. An apparatus according to claim 1, comprising a temperature measurement device for determining the temperature of the casing of the roller and/or a device for determining the temperature in the interior void space of the roller.

* * * * *

UNITED STATES PATENT AND TRADEMARK OFFICE

CERTIFICATE OF CORRECTION

PATENT NO. : 7,614,122 B2
APPLICATION NO. : 11/415187
DATED : November 10, 2009
INVENTOR(S) : Pferdmenges et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 774 days.

Signed and Sealed this

Nineteenth Day of October, 2010

David J. Kappos

David J. Kappos
*Director of the United States Patent and Trademark Office*